US005835108A

United States Patent [19]

Beauchamp et al.

[11] Patent Number: 5,835,108

[45] Date of Patent: Nov. 10, 1998

[54] CALIBRATION TECHNIQUE FOR MIS-DIRECTED INKJET PRINTHEAD NOZZLES

[75] Inventors: Robert W. Beauchamp, Carlsbad, Calif.; Ignacio Ruiz Conejo, Sant Cugat del Valles, Spain

[73] Assignee: Hewlett-Packard Company, Palo Alto, Calif.

[21] Appl. No.: 719,606

[22] Filed: Sep. 25, 1996

[51] Int. Cl.[6] ..... B41J 29/393

[52] U.S. Cl. ..... 347/19; 400/74

[58] Field of Search ..... 400/74, 279; 347/5, 347/14, 16, 19, 39

[56] References Cited

U.S. PATENT DOCUMENTS

| | | | |
|---|---|---|---|
| 5,448,269 | 9/1995 | Beauchamp et al. | 347/19 |
| 5,534,895 | 7/1996 | Lindenfelser et al. | 347/19 |
| 5,600,350 | 2/1997 | Cobbs et al. | 347/19 |

*Primary Examiner*—John S. Hilten
*Attorney, Agent, or Firm*—David S. Romney

[57] ABSTRACT

Method and apparatus for calibrating an inkjet printhead by printing separate test patterns from respective groups of nozzles on the same printhead, and then using a carriage-mounted optical sensor to scan the patterns to determine the relative locations of the ink drops from each group of nozzles.

9 Claims, 8 Drawing Sheets

CALIBRATION TECHNIQUE FOR MIS-DIRECTED INKJET PRINTHEAD NOZZLES

BACKGROUND OF THE INVENTION

This invention relates generally to inkjet printing, and more specifically to the use of inkjet printheads having having multiple ink-ejection nozzles The development of high resolution inkjet printheads such as 600 dpi printheads has created the need to compensate for individual ink-ejection nozzles which for various reasons direct ink drops in diverse directions toward the print media. This is especially true where inkjet printers are used to print color images or precise engineering drawings.

Prior techniques have been used to compensate for mis-alignment between the nozzles of one print cartridge as compared to the nozzles of another print cartridge on the same scanning carriage, but there is a need for a new technique to detect when certain nozzles or groups of nozzles on a printhead are mis-directing ink drops in different directions toward the print media.

SUMMARY OF THE INVENTION

The invention provides for a first group of ink drops applied as a test pattern on a pixel grid by certain nozzles on an inkjet printhead, and a second group of ink drops applied as a test pattern on the pixel grid by different nozzles on the same inkjet printhead. An optical sensor on a scanning carriage passes over the test patterns to compare the relative positions of the ink drops on the pixel grid.

Brief Description of the Drawings

A typical embodiment of the invention is exemplified in a large fort color inkjet printer/plotter as shown in FIGS. 1–2. More specifically, FIG. 1 is a perspective view of an inkjet printer/plotter 210 having a housing 212 mounted on a stand 214. The housing has left and right drive mechanism enclosures 216 and 218. A control panel 220 is mounted on the right enclosure 218. A carriage assembly 300, illustrated in phantom under a cover 222, is adapted for reciprocal motion along a carriage bar 224, also shown in phantom. The position of the carriage assembly 300 in a horizontal or carriage scan axis is determined by a carriage positioning mechanism 310 with respect to an encoder strip 320 (see FIG. 2). A print medium 330 such as paper is positioned along a vertical or media axis by a media axis drive mechanism (not shown). As used herein, the media axis is called the X axis denoted as 201, and the scan axis is called the Y axis denoted as 301.

FIG. 2 is a perspective view of the carriage assembly 300, the carriage positioning mechanism 310 and the encoder strip 320. The carriage positioning mechanism 310 includes a carriage position motor 312 which has a shaft 314 which drives a belt 324 which is secured by idler 326 and which is attached to the carriage 300.

The position of the carriage assembly in the scan axis is determined precisely by the encoder Strip 320. The encoder strip 320 is secured by a first stanchion 328 on one end and a second stanchion 329 on the other end. An optical reader (not shown) is disposed on the carriage assembly and provides carriage position signals which are utilized by the invention to achieve optimal image registration in the manner described below.

Figure 1:
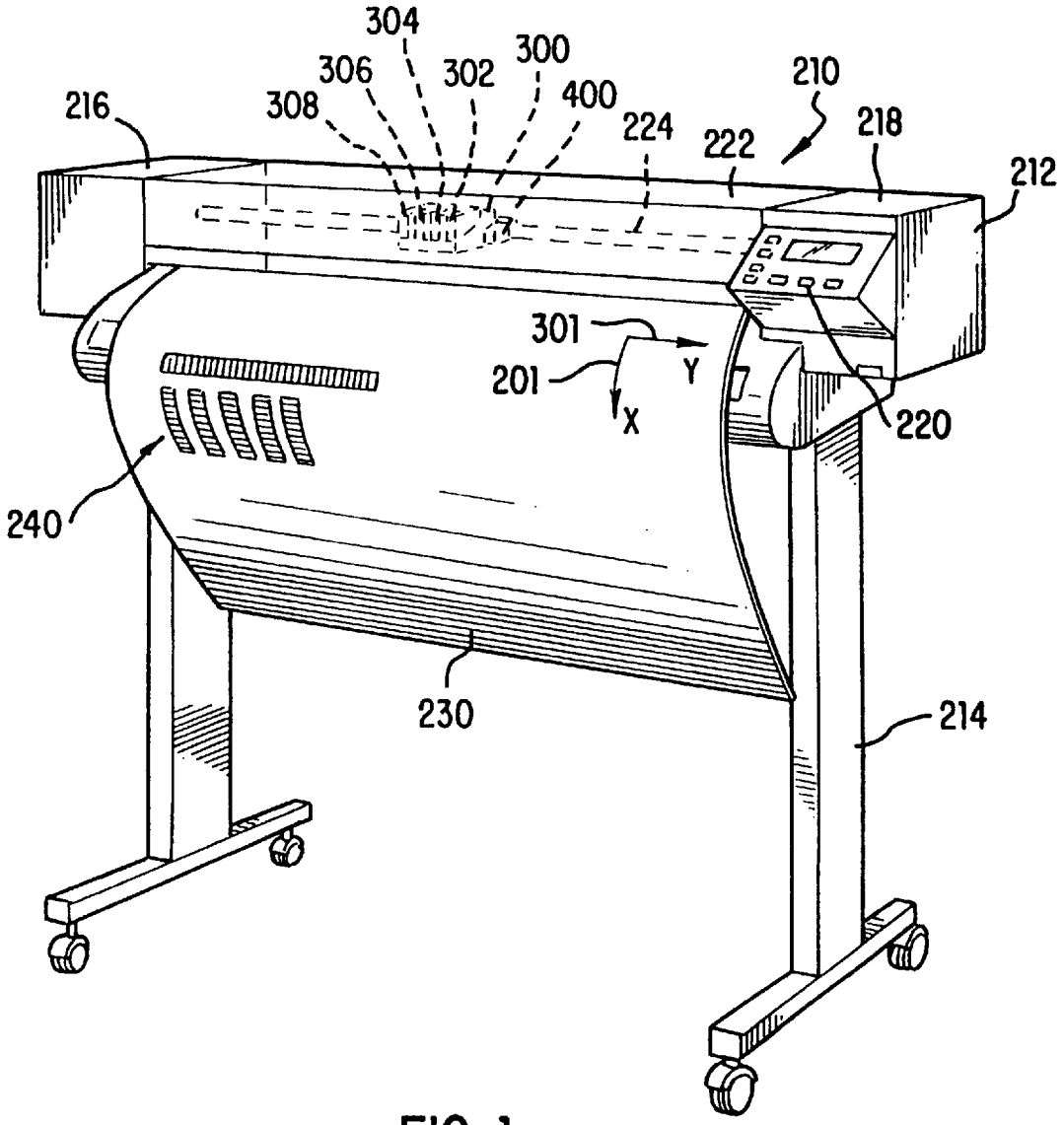
FIG. 1 is a perspective view of a large format inkjet printer/plotter incorporating the features of the present invention.
Figure 2:
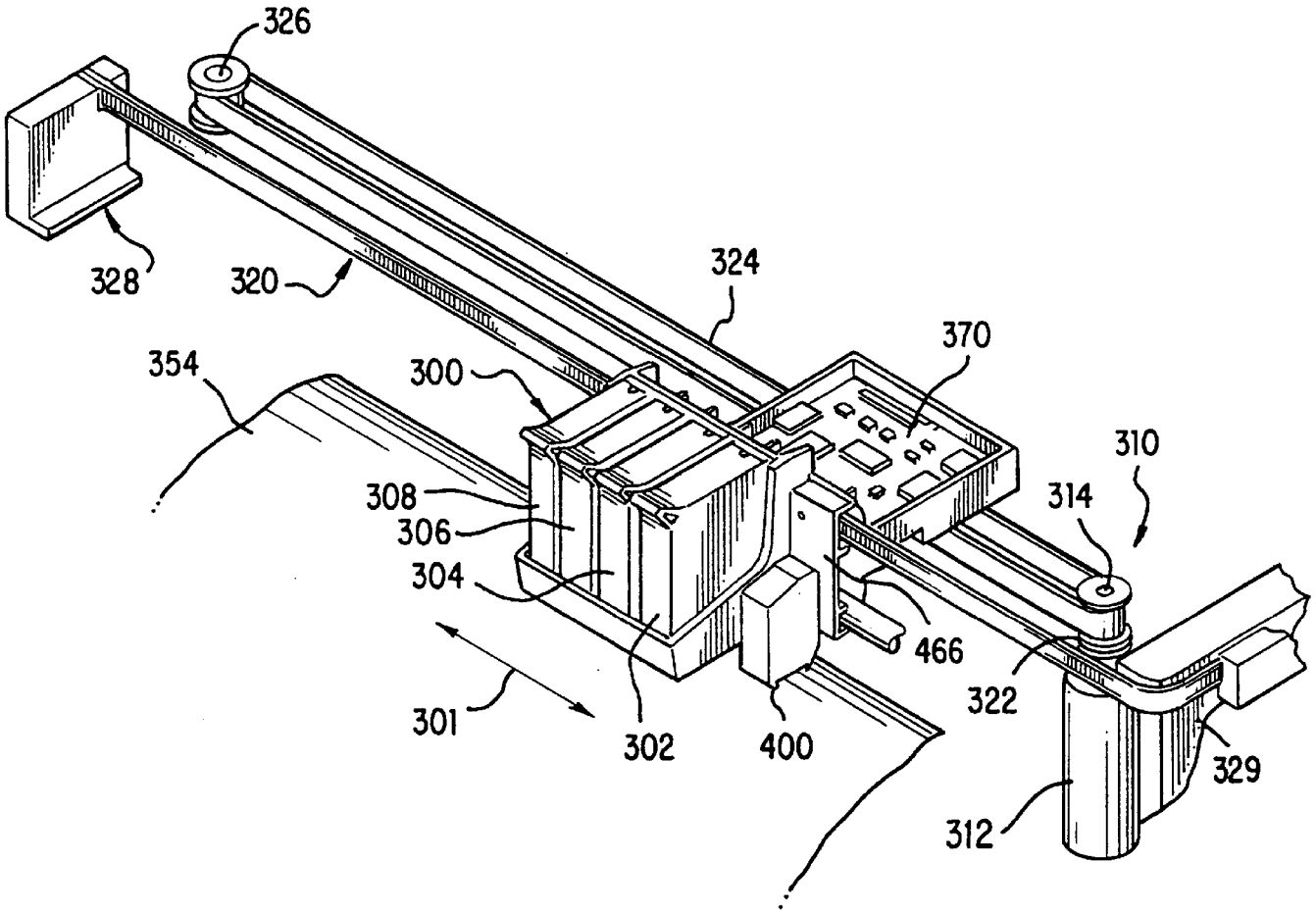
FIG. 2 is a close-up view of the carriage portion of the printer/plotter of FIG. 1 showing a carriage-mounted optical sensor of the present invention.
Figure 3:
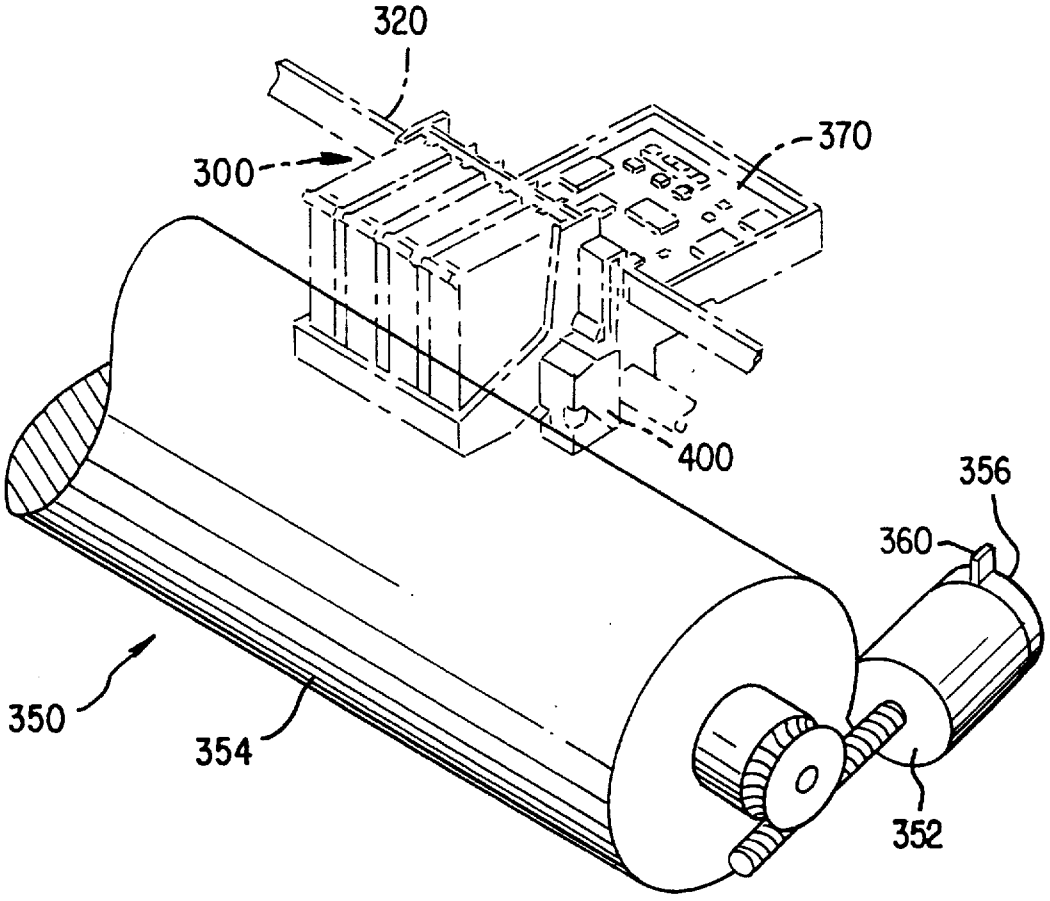
FIG. 3 is a close-up view of the platen portion of the printer/plotter of FIG. 1 showing the carriage portion in phantom lines.

FIG. 3 is perspective view of a simplified representation of a media positioning system 350 which can be utilized in the inventive printer. The media positioning system 350 includes a motor 352 which is normal to and drives a media roller 354. The position of the media roller 354 is determined by a media position encoder 356 on the motor. An optical reader 360 senses the position of the encoder 356 and provides a plurality of output pulses which indirectly determines the position of the roller 354 and, therefore, the position of the media 230 in the X axis.

The media and carriage position information is provided to a processor on a circuit board 370 disposed on the carriage assembly 100 for use in connection with printhead alignment techniques of the present invention.

The printer 210 has four inkjet print cartridges 302, 304, 306, and 308 that store ink of different colors, e.g., black, magenta, cyan and yellow ink, respectively. As the carriage assembly 300 translates relative to the medium 230 along the X and Y axes, selected nozzles in the inkjet print cartridges 302, 304, 306, and 308 are activated and ink is applies to the medium 230. The colors from the three color cartridges are mixed to obtain any other particular color. Sample lines 240 are typically printed on the media 230 prior to doing an actual printout in order to allow the optical sensor 400 to pass over and scan across the lines as part of the initial calibration.

The carriage assembly 300 positions the inkjet print cartridges and holds the circuitry required for interface to the ink firing circuits in the print cartridges. The carriage assembly 300 includes a carriage 301 adapted for reciprocal motion on front and rear slider rods 303, 305.

As mentioned above, full color printing and plotting requires that the colors from the individual print cartridges precisely applied to the media. This requires precise alignment of the carriage assembly as well as precise alignment of the print cartridges in the carriage. Unfortunately, paper slippage, paper skew, and mechanical misalignment of the print cartridges results in offsets in the X direction (in the media advance axis) and in the Y direction (in the carriage or axis) as well as angular theta offsets. This misalignment causes misregistration of the print images/graphics formed by the individual ink drops on the media. This is generally unacceptable as multi-color printing requires image registration accuracy from each of the printheads to within 1/1000 inch (1 mil).

Figure 4:
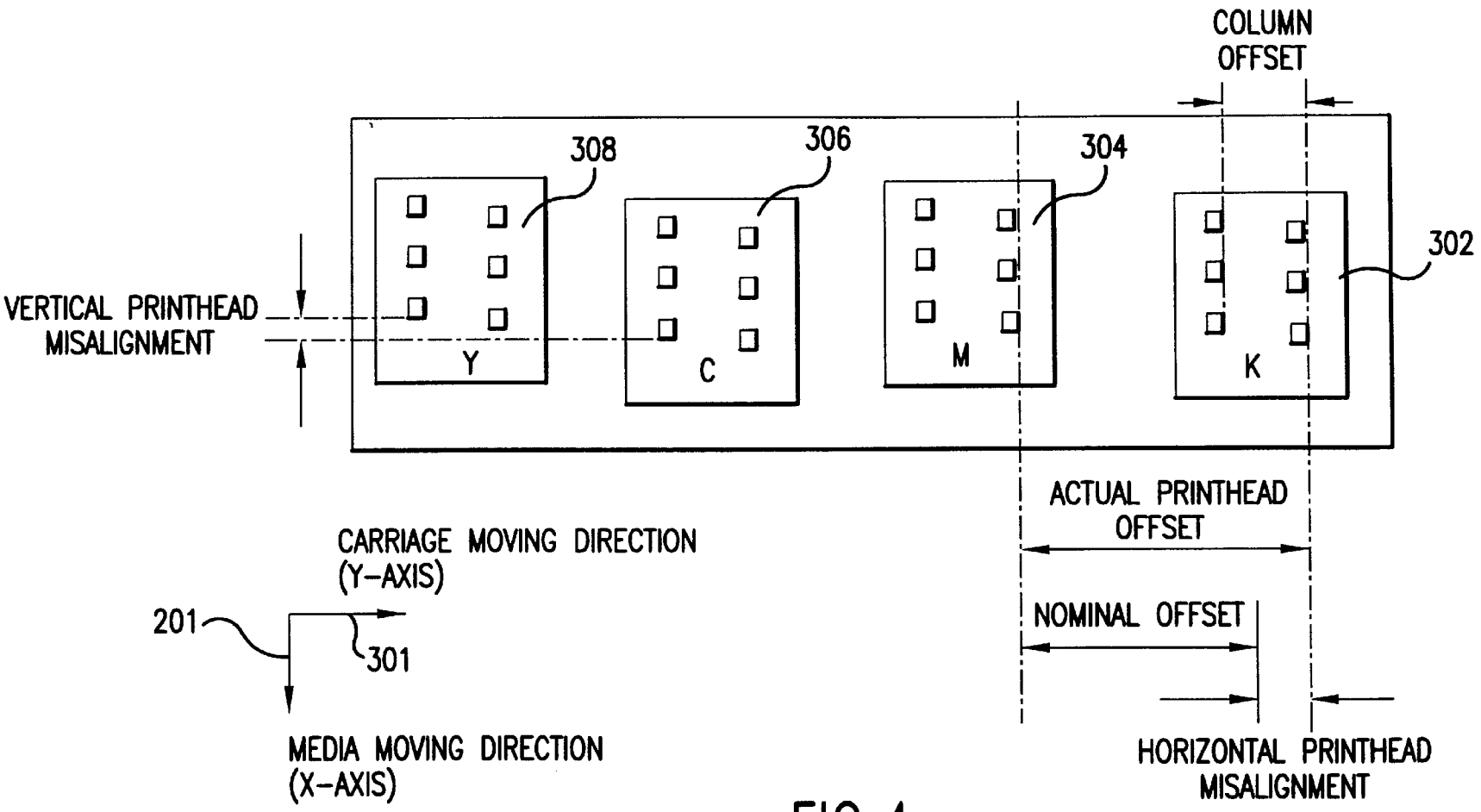
FIG. 4 is a schematic representation of a top view of the carriage showing offsets between individual printheads in the media advance axis and in the carriage scan axis.

FIG. 4 shows a presently preferred embodiment of printheads each having two groups of nozzles with a column offset 410. By comparing the relative positions of corresponding nozzles in different printheads along the Y axis, it is possible to determine an actual horizontal offset 412 between two printheads, and by comparison with a nominal default offset 414 determine an actual offset 416 in the carriage scan axis. This is repeated for all of the different printheads while they remain on the carriage.

Similarly, by comparing the relative positions of corresponding nozzles in different printheads along the X axis, it is possible to determine an actual vertical offset 418 in the media advance axis. This is also repeated for all of the different printheads while they remain on the carriage.

Figure 5:
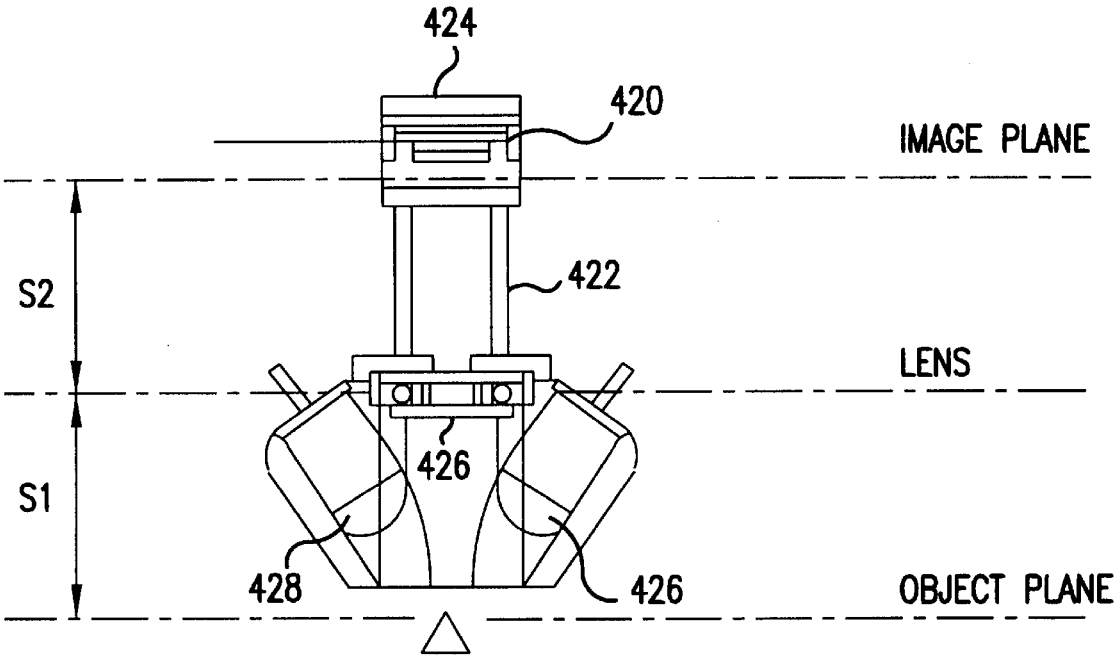
FIG. 5 is a front view of the optical components of the sensor unit of FIG. 4.
Figure 6B:
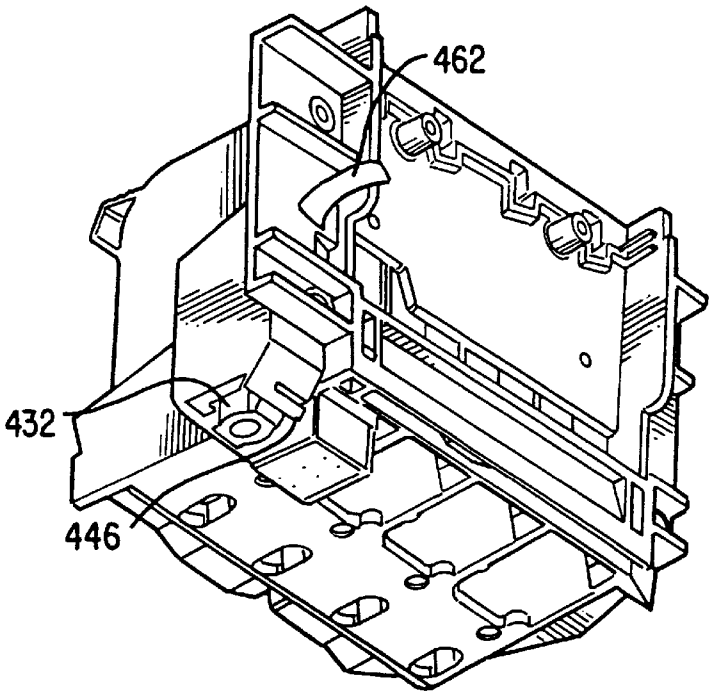
FIGS. 6A and 6B are isometric views respectively looking downwardly and upwardly toward the carriage slowing the optical sensor and one print cartridge mounted on the carriage.
Figure 6A:
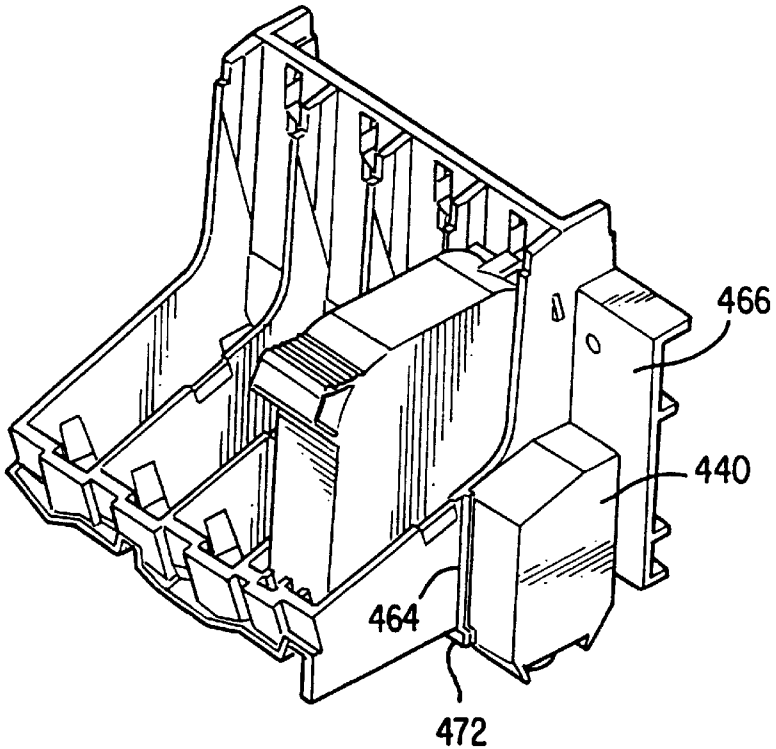

In order to accurately scan across a test pattern line, the Optical sensor 400 is designed for precise positioning of all of its optical components. Referring to FIGS. 5, 6A and 6B, the sensor unit includes a photocell 420, holder 422, cover 424, lens 426; and light source such as two LEDs 428, 430. A protective casing 440 which also acts as an ESD shield for sensor components is provided for attachment to the carriage.

Additional details of the function of a preferred optical sensor system and related printing system are disclosed in copending application Ser. No. 08/551,022 filed 31 Oct. 1995 entitled OPTICAL PATH OPTIMIZATION FOR LIGHT TRANSMISSION AND REFLECTION IN A CARRIAGE-MOUNTED INKJET PRINTER SENSOR, which application is assigned to the assignee of the present application, and is hereby incorporated by reference.

Generally speaking, an optical on-carriage sensor system is used to determine the position of the alignment patterns which are printed separately for each printhead which is to be calibrated. In other words, one overall alignment pattern incorporates ink drops from a first set of nozzles on a printhead in one portion of the test pattern, while ink drops from a second set of nozzles on the same printhead are incorporated in as separate but horizontally aligned portion of the test pattern. (See FIGS. 9A, 9B and 9C).

The optical sensor in the preferred embodiment includes two LEDs, one green and one blue. The green LED produces a greater signal than the blue LED and is used to scan all the patterns except the patterns used to obtain information from the yellow ink printhead. The signal read from the optical sensor is processed and entered to an analog-to-digital converter. Three different channels are available: a 1st channel with a DC gain of 2, a 2nd channel with an AC gain of 100, and a 3rd channel with an AC gain of 150. The intensity of the LEDs can be independently controlled by setting the appropriate value on the digital-to-analog converter (values from 0 to 63). With the green LED the 2nd channel output is used, while for the blue LED, the 3rd channel output is used.

Before scanning the alignment pattern, the intensity for the green LED is established at a fixed value in order to obtain the highest value that does not saturate the system. This is done by moving the carriage over the white paper and then increasing progressively the green LED intensity from 0 (minimum intensity) to the first value that produces a maximum sensor read (255) on the 1st channel. A factor of 0.75 is applied to that so-called saturation value and the result is used throughout all of the alignment sensing procedures. The blue LED is always set to its maximum intensity (63) as in this case the system is never saturated.

The technique of the invention is designed to correct directional misalignment of nozzles in the carriage scan axis, but the principle can be applied to directional misalignment in other axes also.

Figure 7:
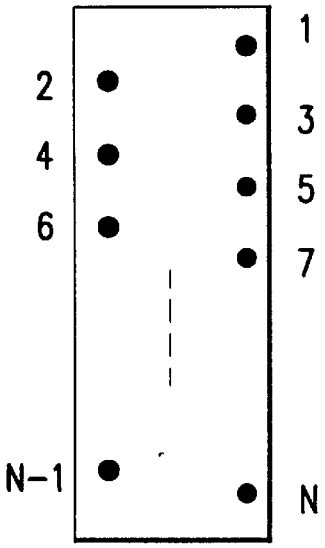
FIG. 7 schematically shows the nozzle plate of a 600 dpi print cartridge having one column of ink-ejection nozzles separated from another column of ink-ejection nozzles.
Figure 8:
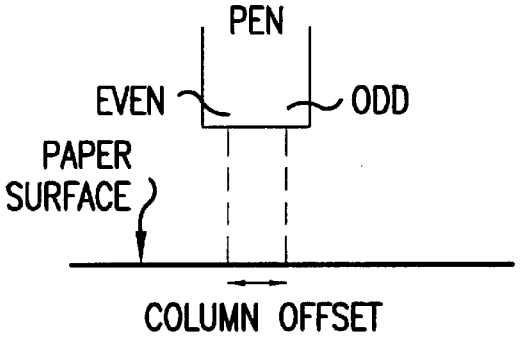
FIG. 8 schematically shows the print cartridge of FIG. 7 in printing position over a print zone.

As shown in FIG. 7, the nozzles in an individual printhead of the presently preferred embodiment are ordered in two columns separated a fixed distance. One column contains the even-numbered nozzles and the other column=contains the odd-numbered nozzles. For example, in a black ink 600 dpi printhead, the distance in the media advance direction between nozzle #1 and nozzle #2 is 1/600th inch ("nozzle pitch"). However, the nominal separation between the columns can vary. For example, in the black ink 600 dpi printheads of the exemplary embodiment, the nominal pixel separation on a 600×600 dpi grid is 97 pixels (approximately 4.106 mm), while in each of the color ink 300 dpi printheads (cyan, magenta, yellow), the nominal pixel separation on a 600×600 dpi grid is 16 pixels (approximately 0.677 mm).

When the actual column offset is determined by optically scanning the test pattern, a column offset correction is applied to the firing position of all the nozzles in one of the columns. In the preferred embodiment, the nominal offset for the color ink 300 dpi printheads was deemed accurate enough. However different printhead parameters could very well justify applying a corrective adjustment to a group of color ink nozzles as well.

Figure 9A:
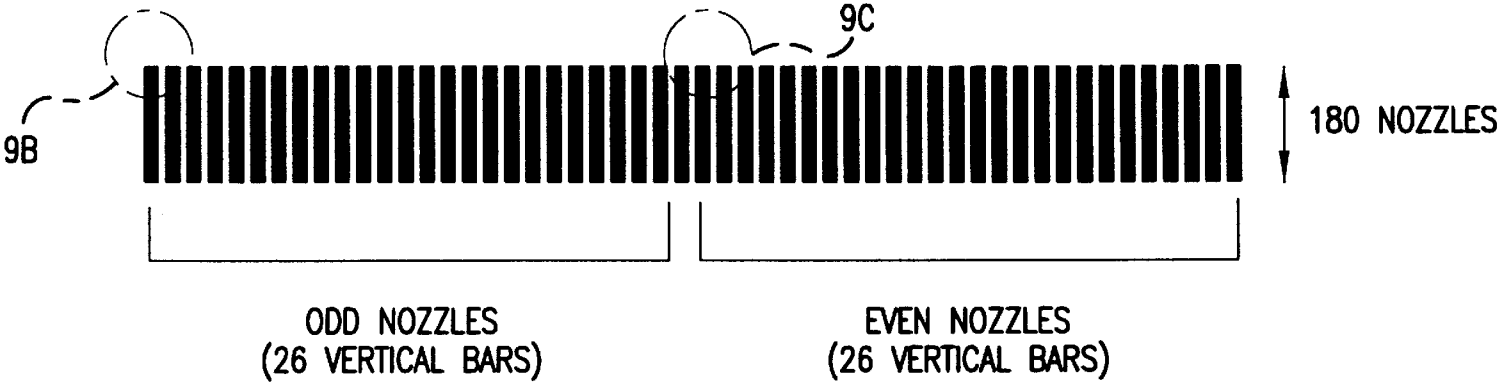
FIGS. 9A, 9B and 9C show the nozzle sources of test patterns incorporating features of the present invention.
Figure 9C:
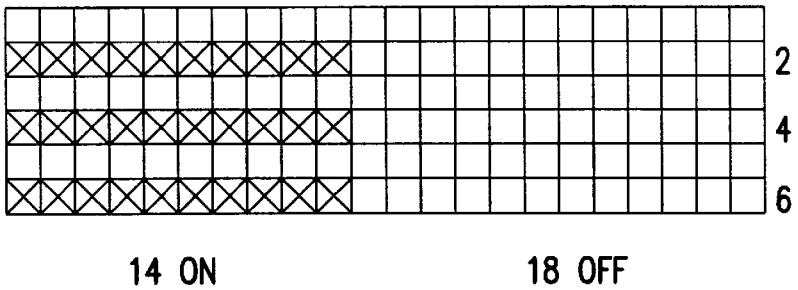
Figure 9B:
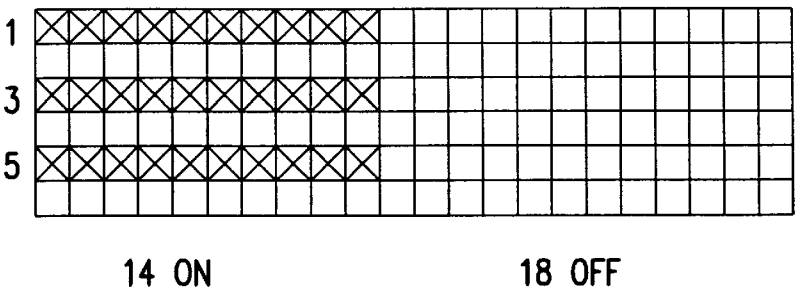

FIGS. 9A, 9B and 9C show the relatively positioned pixel patterns to be printed and scanned. Based on the signals outputs obtained from the sensor, a value obtained for the actual column offset is rounded to an integer in 600 dpi units. This alignment procedure is preferably performed initially before performing any other alignment calibrations using test patterns, in order to sharpen up the lines/bars that will be used in generating the other alignment patterns.

The scanning of these black ink patterns is done using the green LED and the 2nd sensor channel, with a scanning speed of 6 inches per second (6 ips).

Figure 10A:
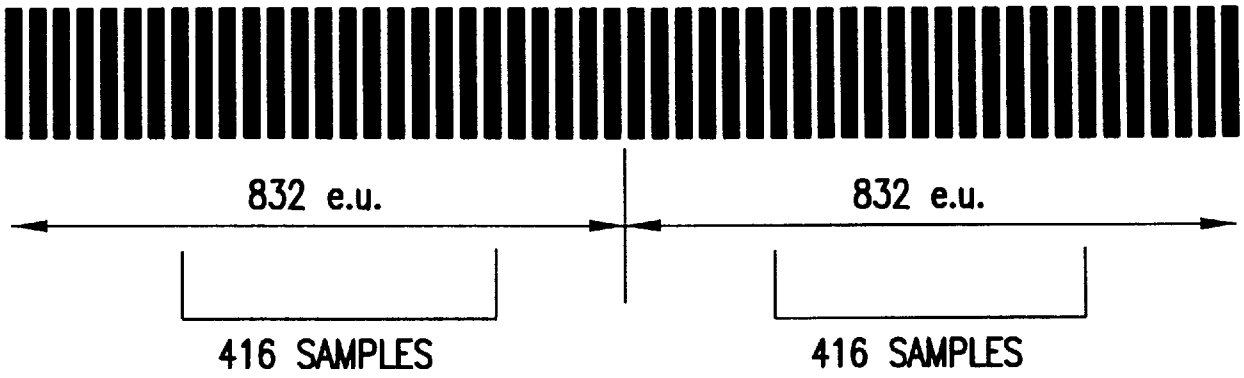
FIGS. 10A and 10B show the location and spacing for the bar pattern incorporating featues of the present invention.
Figure 10B:
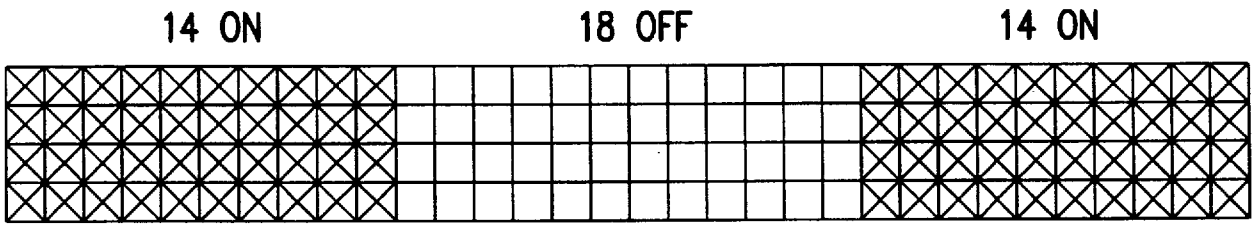

The scanning routine obtains samples at 600 samples/inch centered half portion of each test pattern (see FIGS. 10A–10B).

It will be understood by those skilled in the art that various modifications can be made to the exemplary embodiments shown and described herein without departing from the spirit and the invention as defined by the following claims:

We claim as our invention:

1. A method of sensing directional aberrations among inkjet printhead nozzles on the same printhead, comprising the following:

mounting a given printhead on a scanning carriage;

selecting one group of nozzles on said given printhead and printing from said one group a first repeating pattern on a pixel grid;

selecting on said given printhead another group of nozzles different from said one group and printing from said another group a second repeating pattern on the pixel grid in a location spaced apart from said first repeating pattern; and optically sensing the relative positions of the first and second patterns in order to determine any directional deviation of said nozzles which may require correction.

2. The method of claim 1 which further includes printing the second pattern on the same resolution pixel grid which has the first pattern.

3. The method of claim 2 which further includes making an offset correction which is applied to all of the nozzles in said one or said another group.

4. The method of claim 1 which further includes printing the first pattern on a first set of target pixels, and printing the second pattern on a second set of target pixels which is different from the first set of target pixels.

5. The method of claim 1 which further includes printing a first pattern of spaced apart vertical bars having a width greater than a single pixel, and printing a second pattern of spaced apart vertical bars having a width greater than a single pixel.

6. Apparatus for calibrating inkjet nozzles, comprising:

a first group of nozzles in the printhead;

a second group of nozzles in the same printhead;

a carriage for holding the printhead;

said first group printing a first multiple bar test pattern and said second group printing a second multiple bar test pattern spaced in a scanning direction from the first multiple bar test pattern;

an optical sensor on said carriage for sensing the relative location of the first multiple bar test pattern of ink drops from said first group as compared to the second multiple bar test pattern of ink drops from said second group.

7. The apparatus of claim 6 wherein said first group of nozzles forms a first column on said printhead, and said second group of nozzles forms a second column on said printhead separated from said first column.

8. The method of claim 7 which includes printing a first pattern of vertical bars having a width less than a non-printed space between adjacent bars, and printing a second pattern of vertical bars having a width less than a non-printed space between adjacent bars.

9. The method of claim 2 which includes making an offset correction which is rounded to one or more pixel integers.

* * * * *